United States Patent [19]

Braun

[11] 4,104,807

[45] Aug. 8, 1978

[54] MACHINE FOR THE CONTINUOUS PREPARATION AND PACKAGING OF FREEZE-DRIED MATERIALS

[75] Inventor: Hans Braun, Ilvesheim, Fed. Rep. of Germany

[73] Assignee: Boehringer Mannheim GmbH, Mannheim, Fed. Rep. of Germany

[21] Appl. No.: 783,896

[22] Filed: Apr. 1, 1977

[30] Foreign Application Priority Data

Apr. 10, 1976 [DE] Fed. Rep. of Germany ..... 2615815

[51] Int. Cl.[2] ..... F26B 13/28; F26B 13/30; F26B 15/22

[52] U.S. Cl. ..... 34/92; 34/5; 53/86; 53/90

[58] Field of Search ..... 34/5, 92, 28, 31; 53/86, 90

[56] References Cited

U.S. PATENT DOCUMENTS

| | | | |
|---|---|---|---|
| 1,572,326 | 2/1926 | Straight | 34/28 X |
| 2,554,560 | 5/1951 | Craig | 34/92 |
| 2,858,795 | 11/1958 | Walker | 34/92 X |
| 3,973,665 | 8/1976 | Glammanco | 34/92 X |

*Primary Examiner*—John J. Camby
*Attorney, Agent, or Firm*—Burgess, Dinklage & Sprung

[57] ABSTRACT

An apparatus for the continuous preparation and packing of freeze-dried material, having a horizontally movable web and successively disposed forming, freezing, freeze-drying, heat-sealing, punching and transport devices. The freeze-drying devices consist of two successively disposed freezers having separate refrigerant circuits, and a primary drying tunnel and a secondary drying tunnel having separate evacuating and heating systems and hermetically closable air locks located ahead of the primary drying tunnel, between the primary and secondary drying tunnels, and at the end of the secondary drying tunnel the air locks comprise compressible and expandable walls, retractable tables and upwardly and downwardly opening slide valves for sealing the primary drying tunnel hermetically from the secondary drying tunnel. An advancing mechanism is coupled to the air locks and movable in the horizontal direction for advancing the movable web in conjunction with the expansion and compression of the air lock walls.

7 Claims, 15 Drawing Figures

MACHINE FOR THE CONTINUOUS PREPARATION AND PACKAGING OF FREEZE-DRIED MATERIALS

BACKGROUND

The present invention concerns a machine for the continuous production and packing of freeze-dried material, which has molding, filling, freezing, freeze-drying, heat-sealing, punching and transport means.

Machinery by which foils can be formed, filled and sealed is already known (German "Offenlegungsschrift" No. 2,164,500). Continuous freeze-drying apparatus are also known in which the frozen material in transport containers is introduced through an entrance air lock into the drying chamber, where it is further advanced, freeze-dried, and then transported out of the freeze-drying chamber through an exit air lock (German "Offenlegungsschrift" No. 1,729,212 and No. 1,729,226).

THE INVENTION

The invention is addressed to the problem of packing the material that is to be freeze-dried into the containers, freezing it therein, freeze-drying it and sealing it in air-tight or moisture-proof manner in a plurality of rows simultaneously, while the containers pass continuously or cyclically through the apparatus. Another object of the invention is to produce the containers for the material within the apparatus (e.g., deep-drawn foil cups).

This problem is surprisingly solved in that a conveyor carrying the containers is gripped by the sliding valves of air locks equipped with extensible walls, and the conveyor is transported section by section through the freezers and through the evacuated freeze-drying tunnels by the advancing movement of the said air locks.

In a preferred embodiment of the invention, containers (deep-drawn cups, for example) of any desired shape are formed in several rows simultaneously in the metal foil or plastic film web passing through the machine. Then the material to be freeze-dried is placed in the containers and frozen therein, freeze-dried, and sealed in an airtight or moisture-proof manner, the formed and filled foil or film web being gripped between the rows of cups by the air lock slide valves, further transported by the advancing movement of the air locks equipped with extensible walls, and carried section by section through the freezers and through the evacuated freeze-drying tunnel. The material to be freeze-dried is placed in the cups in the form of a solution or in the form of a spray-dried granular material which can also have been formed previously into tablets. The advancing of the foil or film web is performed by the advancing means and the air locks coupled with the advancing means.

Another feature of the invention consists in the fact that, during the section-by-section transport of the containers, some of the filled cups are always present in the freezers, some are in the primary drying tunnel and some in the secondary drying tunnel, the secondary drying tunnel being sealed off hermetically from the primary drying tunnel, so that a lower pressure and a higher drying temperature can be used in the secondary drying tunnel than in the primary drying tunnel, and so that, during the freeze-drying process, the pressures and the drying temperatures will change only within narrow limits, in contrast to batch-wise operation.

In another embodiment, material to be dried can also be charged into bottles and continuously frozen, freeze-dried and sealed in a moisture-proof manner. In this case, instead of the formed foil or film web, a thin, approximately 0.5 mm thick, circulating conveyor belt consisting of metal (preferably steel) or of plastic, is used. The conveyor belt can consist also of two circulating metal bands joined by spacing means and provided with guides, which transport and laterally guide the bottles. The conveyor belt in this embodiment is carried over end drums at the entrance and exit of the machine. The advancing movement, as described with reference to the film or foil web embodiment, is transmitted to the locks and to the conveyor belt by a push-pull means. The air lock slide valves which grip the conveyor belt or the metal bands, open upwardly in this embodiment, not downwardly as in the case of the transport of the foil or film web. The places on the conveyor belt which are gripped by the air lock slide valves are defined by cleats, so that no bottles can stand at these points.

The air locks are equipped with retractable trays consisting of metal foil or plastic film and bearing the bottles, in the case in which the conveyor belt consists of two metal bands joined by spacers.

The bottles are filled with the solution to be freeze-dried by a filling and stoppering machine and are provided with freeze-drying stoppers. Then they are pushed onto the conveyor belt and move along the path, described above in connection with the foil or film web, through the freezers, air locks and freeze-drying tunnels. After the last air lock, the freeze-drying stoppers are forced into the bottles by means of a hydraulically operated pressure plate in a hermetically sealed apparatus which is fastened to the air lock and flooded with nitrogen. The bottles are then delivered to a screw capping machine.

The invention shows that material to be freeze-dried can be dried and sealed in a continuous freeze-drying installation more efficiently than in a chamber-type freeze-drying installation by batch-wise operation, if foils or films are used instead of glass bottles for the packaging, or if the product can be freeze-dried in a relatively short time.

The steps required in batch-wise operation are compared with those required in continuous operation as follows:

WORKING STEPS FOR CHAMBER FREEZE-DRYING

| | |
|---|---|
| Continuous Operations: | Clean bottles |
| | Dry bottles |
| | Fill bottles |
| | Install stoppers |
| Batch Operations; | Place batch in freezer |
| | Freeze the solution |
| | Place batch in freeze-dry chamber |
| | Freeze-dry frozen solution |
| | Remove batch from f.d. chamber |
| | Prepare f.d. chamber for next batch, i.e., chill platforms in about 1 h from, e.g., +40° C to −40° C. |
| | Seal bottles |

WORKING STEPS FOR CONTINUOUS FREEZE-DRYING

| | |
|---|---|
| Continuously and fully automatically: | Heat film web |
| | Form film web |
| | Fill film web |

-continued

| |
|---|
| Freeze solution |
| Freeze-dry frozen solution |
| Seal film web |
| Punch packets from foil web. |

The following advantages can be achieved by continuous processes over batch processes:

1. The cost of the packaging material used (foils and films) amounts to only a fraction of the cost of the packaging material used hitherto (bottles + rubber stoppers + screw caps).
2. The investment costs for production machinery can be considerably reduced.
3. Savings can be made in storage floor space, transportation costs for packaging materials and finished goods, and production floor space.
4. Fewer personnel are required.
5. Since in continuous operation only a relatively small amount of material has to be frozen or freeze-dried at one time and the temperature level always remains approximately constant in the refrigeration and heating circuits of the equipment, the refrigeration and heating apparatus can be of considerably more compact design than in the case of a batch-process installation of the same daily output capacity. Due to the more compact design of this machinery, considerable savings can be obtained in the cost of energy (e.g., electric power and cooling water).
6. During the freeze-drying process the bottles are standing in direct contact with the platforms or tables in the freeze-drying tunnel. This permits a better conduction of heat, a more uniform drying, and shorter drying times.

BRIEF DESCRIPTION OF THE DRAWINGS

Examples of the embodiment of the invention are set forth in the following description in conjunction with the appended drawings, wherein.

DETAILED DESCRIPTION OF THE PREFERRED EMBODIMENTS

Figure 1A:
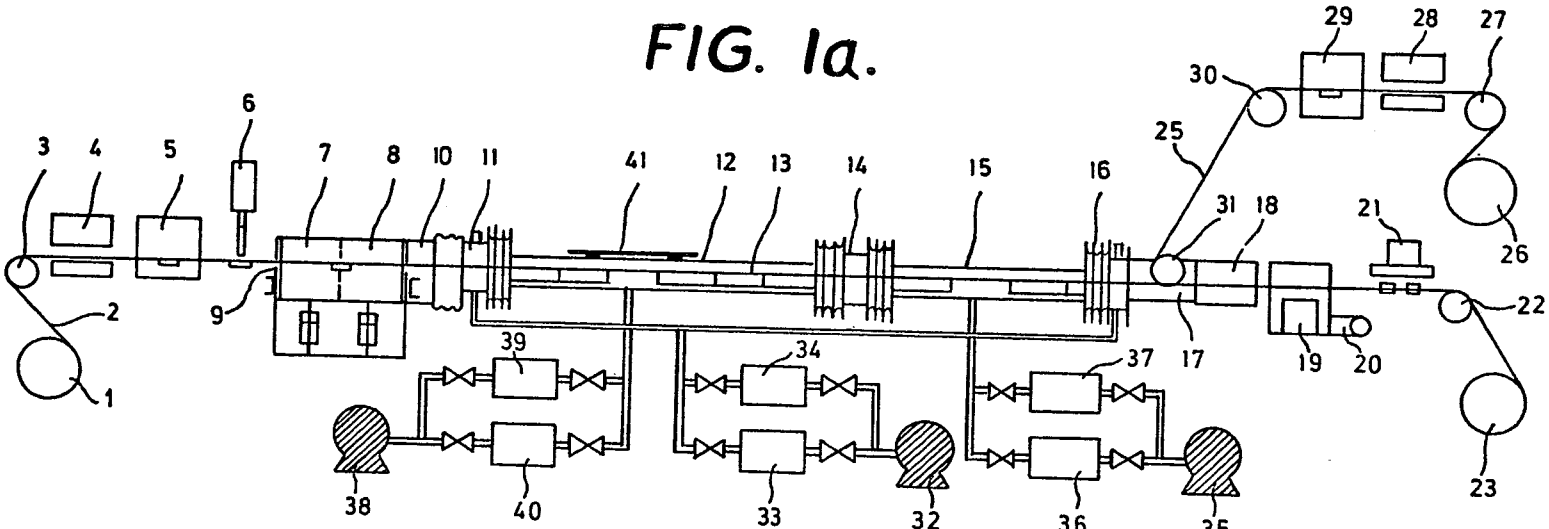
FIGS. 1*a* and 1*b* are a diagrammatic front elevational view and a top plan view respectively, of the machine for freeze-drying in continuous foil bands.
Figure 1B:
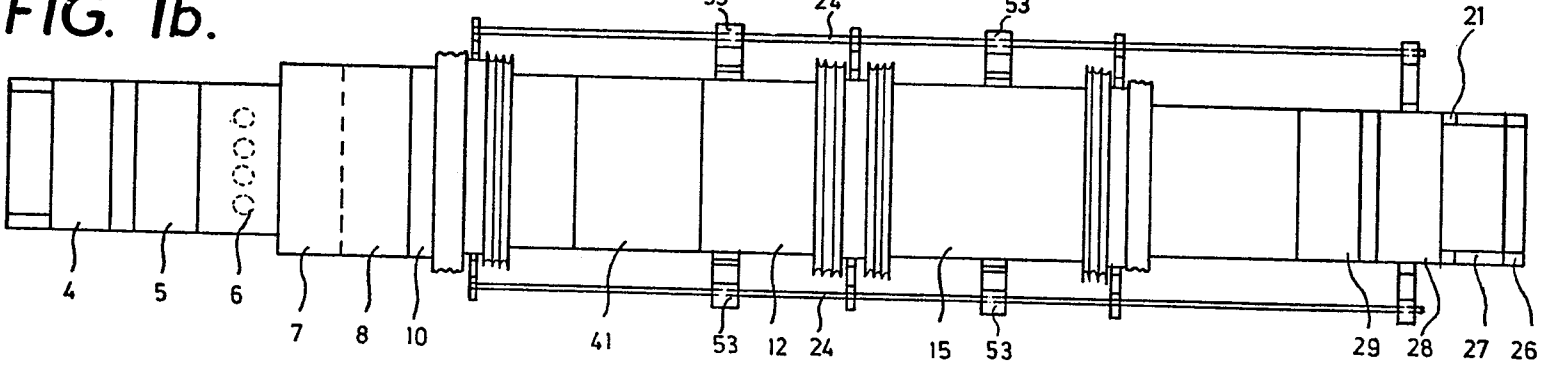

In the overall arrangement of the machine diagrammatically represented in FIG. 1, the continuous metal foil or plastic film 2 is delivered from the supply roll 1 over the guide roll 3 to heating station 4 and to the forming station 5. In forming station 5, a plurality of containers (deep drawn cups) are formed simultaneously adjacent one another. The machine operates cyclically. In one machine cycle the foil or film is advanced over a distance corresponding to one or more rows of containers.

After the forming operation, the deep drawn cups are filled with the solution to be freeze-dried from the stationarily mounted filler 6.

As it continues to advance, the filled foil or film passes through the freezers 7 (preliminary freeze) and 8 (secondary freeze) in which the solution is frozen.

Figure 4A:
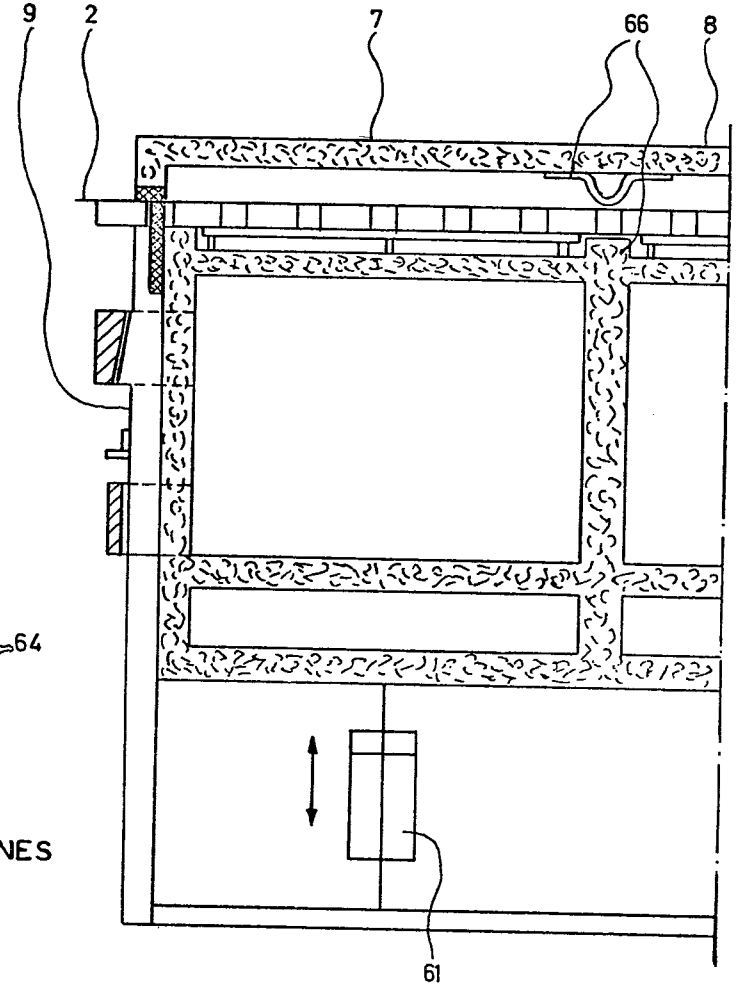
FIGS. 4*a* and 4*b* are a perpendicular longitudinal section taken through the freezers 7 and 8 of the apparatus of FIG. 1, and a perpendicular cross section of same, respectively.
Figure 4B:
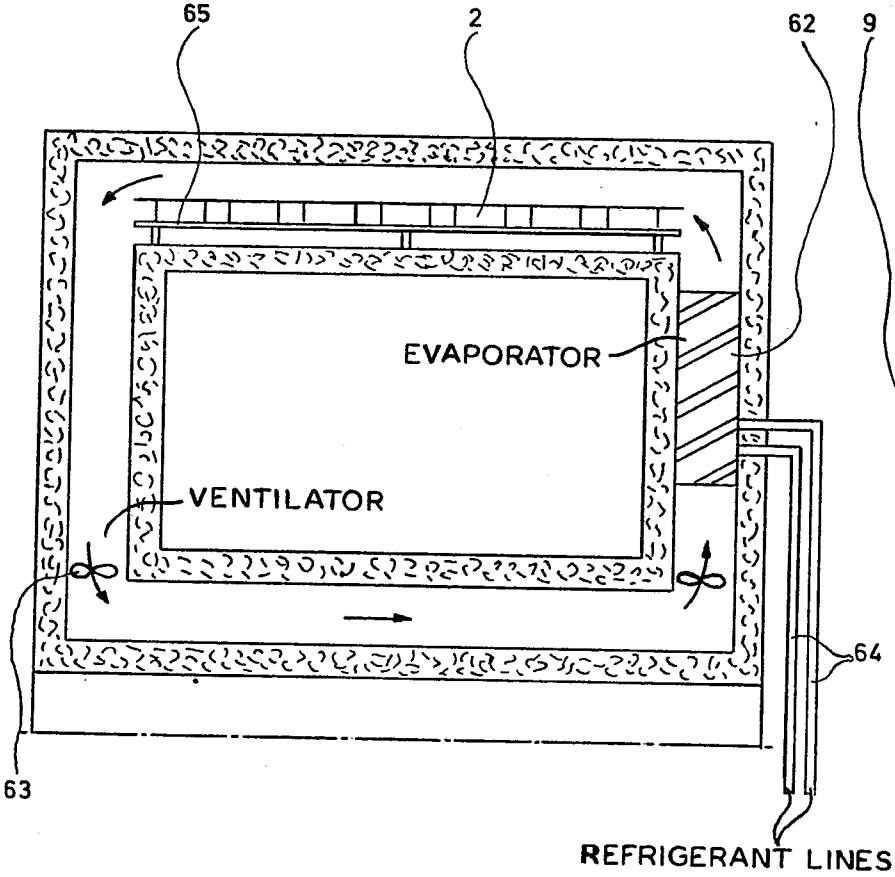

The freezers have slide valves 9, mounted for movement vertically, which are opened and closed hydraulically or pneumatically in step with the machine. The freezers are represented in FIG. 4 and will be further described after the general description of the machine.

In the control station 10 the depth of fill of the frozen material is checked by the automatic descent of measuring plungers onto the surface of the material in step with the machine. The distance to which the measuring plungers descend is the indication of the depth and therefore of the quantity of material placed in the container. Containers filled with amounts above or below the tolerances are removed on the conveyor belt 20 situated beneath the punch 19, a signal being transmitted for this purpose from the control station 10 through a storage to a gate on the conveyor belt 20.

Figure 2A:
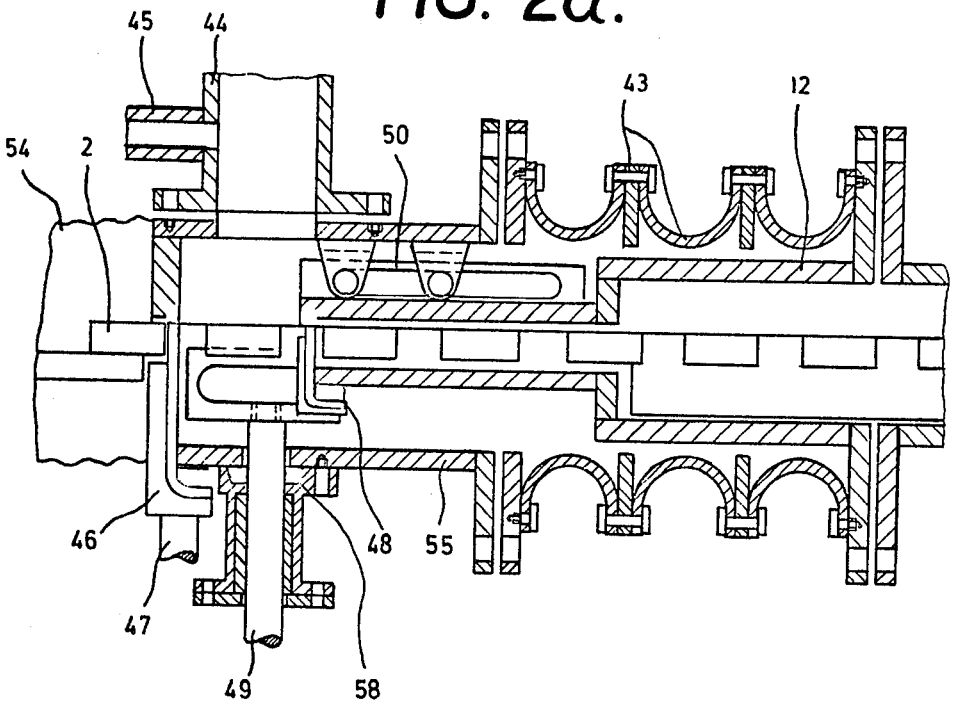
FIGS. 2*a* and 2*b* are a perpendicular longitudinal section taken through the air locks 11 and 14 of the apparatus represented in FIG. 1, and a fragmentary top plan view of same, respectively.

The air lock 11, which is represented in FIG. 2, and which will be further described hereinbelow, hermetically seals off the entrance to the freeze-drying tunnel 12.

The freeze-drying tunnel 12 for the main drying operation is sealed off hermetically by the air lock 14 from the freeze-drying tunnel 15 for the secondary drying operation. This makes it possible to operate the secondary drying tunnel 15 at a higher drying temperature and a lower pressure than the main drying tunnel 12. The air lock 16 seals the exit from the secondary drying tunnel 15 in a vacuum-tight manner.

The transition chamber 17 of the machine has an airtight lining from the air lock 16 to the sealing station 18. The chamber inside of the lining is filled with nitrogen and has a slightly higher pressure than the surrounding atmosphere. The nitrogen gas prevents the material which is to be freeze-dried, and which has only a very low residual moisture content, from absorbing too much moisture from the ambient air before the containers are sealed.

After the covering film or foil 25 has been sealed on at the sealing station 18, deep-drawn sections are die-cut from the film or foil strip at the punch 19 and are carried out by the conveyor belt 20.

The waste strip from which the deep-drawn parts have been die-cut is advanced stepwise by the transport means 21, passed around the guide roller 22 and wound on the reel 23 (waste film or foil).

The cover foil 25 is unwound from the roll 26 and is fed over the guide roller 27 to the heater 28 and forming unit 29. Then it is passed over the guide rollers 30 and 31 into the sealing station 18. In the sealing station the cover foil 25 is sealed onto the shaped and filled bottom foil 2. Both foils, or films as the case may be, then follow the above-described course through the units 19, 20, 21, 22 and 23.

The cover foil 25 can also be sealed on in flat form instead of being shaped.

The push-pull means 24 transmit the advancing motion of the transport means 21 to the air locks 11, 14 and 16. Since a portion of the walls of the locks is of an elastic construction, the locks are able to perform the advancing motion in spite of their vacuum-tight connection to the freeze-drying tunnel. The locks and their advancing movements will be further described after the general description of the machine.

With the vacuum pump 32 represented in FIG. 1, the locks 11 and 16 are evacuated. The water vapor produced from the material being dried precipitates in the form of ice on the coils of condenser 33, which are cooled by the direct injection of a refrigerant. Since the machine operates continuously, the water vapor is passed over the condenser 34 whenever condenser 33 has to be defrosted.

The vacuum pump 38 represented in FIG. 1 evacuates the primary drying tunnel 12 and vacuum pump 35 evacuates the secondary drying tunnel 15. For the continuous operation of the machine, two icing condensers 39, 40 and 36, 37 are connected to each of these two pumps.

Figure 5:
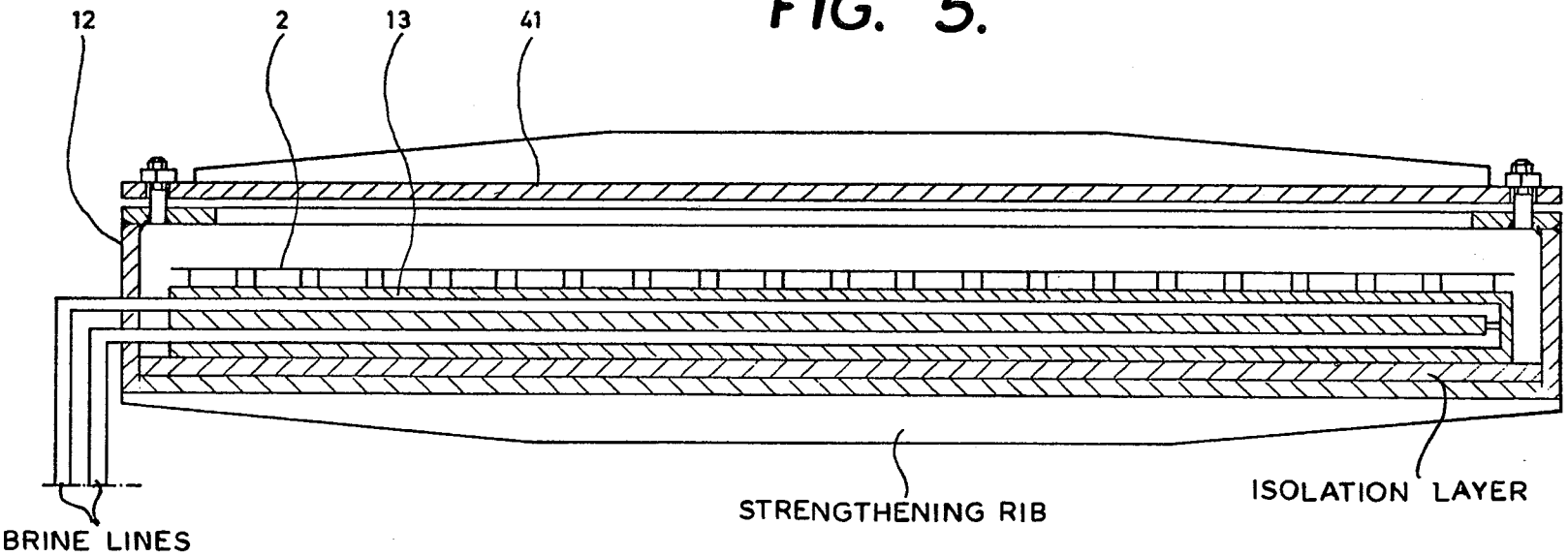
FIG. 5 is a perpendicular cross section of the freeze-drying tunnels 12 or 15.

The tables 13 installed in the freeze-drying tunnel, which serve as a support and guide track for the foil or film web 2, are connected to the brine lines as represented in FIG. 5. The brine, which is cooled in heat exchangers by a coolant or heated by electrical heating rods in a known manner and pumped through the tables by circulation pumps, carries the heat required for the freeze-drying process to the material through the tables. Alternatively, the material to be freeze-dried can also be heated by means of electrical heating rods installed in the tunnel. In this case, a number of round rods are mounted under the foil web 2 so as to support it.

The two freeze-drying tunnels 12 and 15 have installation openings for the installation and removal of the tables, these openings being provided with removable cover plates 41.

The air lock 11 represented in FIG. 2 envelops the entry to the freeze-drying tunnel 12. Also located at this entry is the valve 48 which hermetically closes the freeze-drying tunnel 12.

The outside wall of the lock consists of the elastic part 43 and of the rigid part 55. The valve 46 is located in the rigid part 55.

When the lock is in the state represented in FIG. 2, the valve 48 has gripped the foil web 2 between two rows of cups and hermetically seals off the vacuum tunnel 12 from the interior of the air lock. The valve 46 has clamped the foil web 2 between the next rows of cups and seals the interior of the lock against the outer atmosphere in a vacuum-tight manner.

The operation of the air lock is as follows:

(a) Evacuation of the air lock chamber through the connection 44 which is connected to a vacuum pump. The venting line 45 is at this time closed by a valve.
(b) Slide valve 48 opened by downward movement of plunger 49.
(c) Advancing movement of lock 11, which is performed simultaneously by the transport means 21 and by the locks 11, 14 and 16 through the push-pull means 24.
(d) Slide valve 48 closed by upward movement of plunger 49. The two slide valves 46 and 48 have now gripped the foil web between the same rows of cups.
(e) Filling of air lock chamber with nitrogen through the connection 45. At this time the vacuum line 44 is closed by a valve.
(f) Slide valve 46 opened by downward movement of plunger 47.
(g) Return movement of air lock 11 accomplished by the push-pull means 24.
(h) Valve 46 closed by upward movement of plunger 47.
(i) Repetition of operations *a* – *h*.

In the advancing movement, the lock 11 rolls along the guide 50 on parts 51 and 52, guide 50 being fastened to the entry part of the freeze-drying tunnel 12.

Figure 2B:
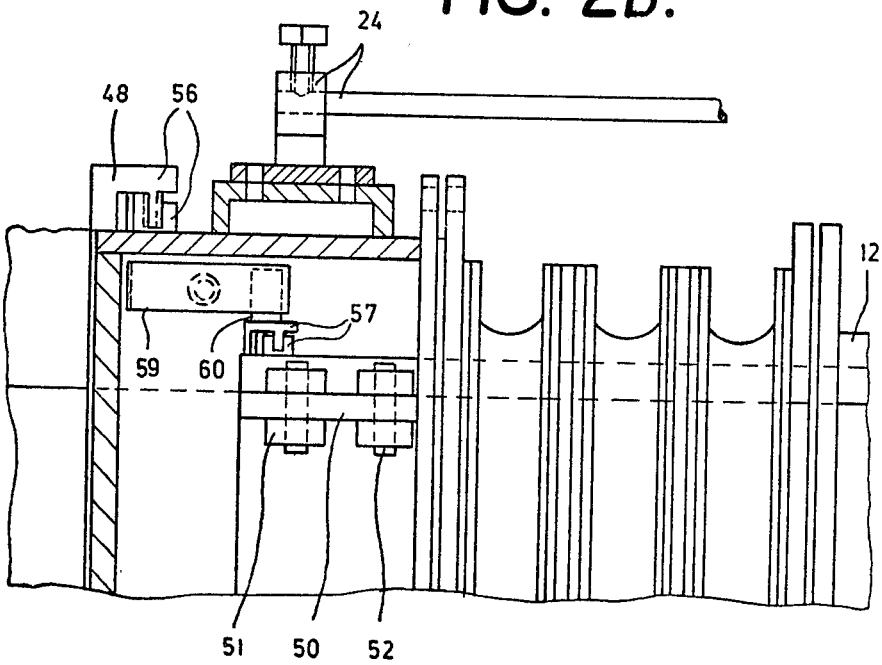

The slide valve 46 is guided, at each end of the freeze-drying tunnel, in the guiding means 56 seen in FIG. 2*b*. Slide valve 48 is guided in the guiding means 57. The plunger 49 is sealed vacuum-tight from the lock chamber by means of a seal located in the guiding piece 58. The movement of the plungers at both ends of the tunnel is transmitted to the slide valves 48 by the forks 59 which are affixed to the plungers 49 and which engage the studs 60 affixed to said slide valves.

The air lock 14 is similar in construction to air lock 11 (FIG. 2), except that the flexible covering 54 is replaced by an elastic, vacuum-tight wall, as represented at 43 in FIG. 2. Leftward of the rigid air lock part 55 there is then provided an elastic wall as a connection to the primary drying tunnel 12, and rightward of the rigid lock part an elastic wall as a connection to the secondary drying tunnel 15.

The operation of the air lock 14 involves the same steps *a* – *i* described in conjunction with lock 11, with the following differences: In step *a*, the air lock chamber is not evacuated by a vacuum pump but through the connection 44, which in this case represents a valved line to the secondary drying tunnel 15 and produces a connection from the lock chamber to the interior of the secondary drying tunnel 15. In step *e*, instead of the filling of the air lock chamber with nitrogen, a connection is established between the air lock chamber and the interior of the primary drying tunnel through the connection 45, which in this case represents a valved connection of the air lock chamber to the primary drying tunnel 12. The other steps are performed as set forth in the description of the operation of lock 11.

Figure 3A:
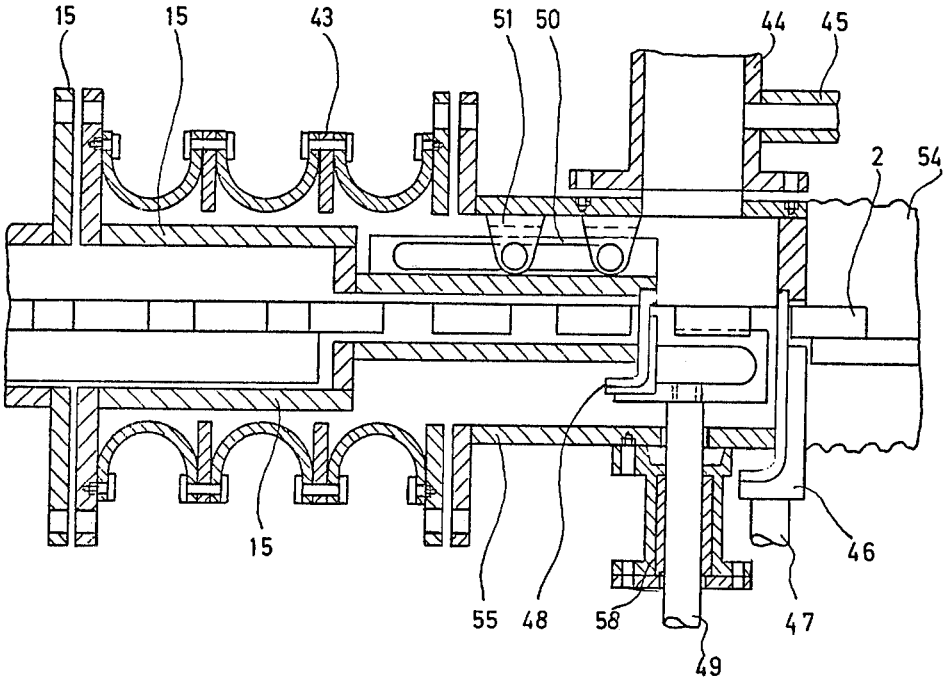
FIGS. 3*a* and 3*b* are a perpendicular longitudinal section taken through the air lock 16 of the apparatus of FIG. 1, and a fragmentary top plan view of same, respectively.
Figure 3B:
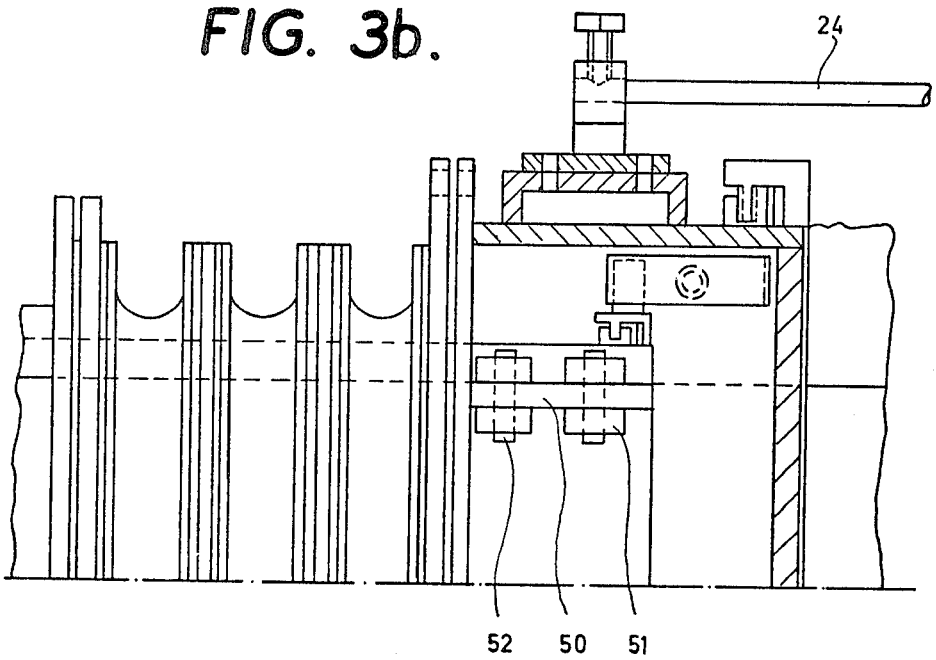

Lock 16 is constructed like lock 11, but, as shown in FIG. 3, it is in a mirror-image relationship to lock 11 and is fastened to the exit from the secondary drying tunnel 15. The flexible wall 54 in this case forms the connection to the transition chamber 17 ahead of the sealing station 18.

The following is a description of the operation of air lock 16, which parallels the operations described in conjunction with air lock 11:

(a) Evacuation of lock chamber through connection 44 which is connected to a vacuum pump. After the evacuation the vacuum line to the pump is shut off by a valve and a connection between the lock chamber and the interior of the secondary drying tunnel 15 is produced through a valved line which branches off from the vacuum line.
(b) Slide valve 48 is opened by downward movement of the plunger 49.
(c) Advancing movement of air lock 16 by push-pull means 24.

(d) Slide valve 48 closed by upward stroke of plunger 49.

(e) Filling of air lock chamber with nitrogen through the connection 45, while vacuum line 44 is closed by a valve.

(f) Slide valve 46 opened by downward stroke of plunger 47.

(g) Return movement of air lock produced by push-pull means 24.

(h) Slide valve 46 closed by upward stroke of plunger 47.

(i) Repetition of steps *a* – *h*.

Upon the transport of the foil web 2 through the freezers 7 and 8, the slide valve 9 represented in FIG. 4 opens and closes the entrance of freezer 7 in step with the machine. A slide valve 9 is also provided at the exit from the freezer 8. Both slide valves are operated hydraulically or pneumatically by the double-acting cylinders 61.

The freezers 7 and 8 have separate refrigerant circuits.

As shown in FIG. 4, the circulating air cooled by the evaporator 62 is positively driven by the fans 63 against the foil web 2, where it removes heat from the solution to be frozen and from the foil web, and yields it back to the evaporator. The evaporator is cooled by the direct injection of a refrigerant. The refrigerant lines 64 are connected to a refrigeration compressor.

The foil or film web 2 is supported on a grid 65 composed of round bars as it passes through the freezers.

Since a lower temperature prevails in freezer 8 than in freezer 7, the two freezers are separated from one another by an insulating barrier 66. This insulating barrier has an opening around the foil or film web 2.

Figure 6A:
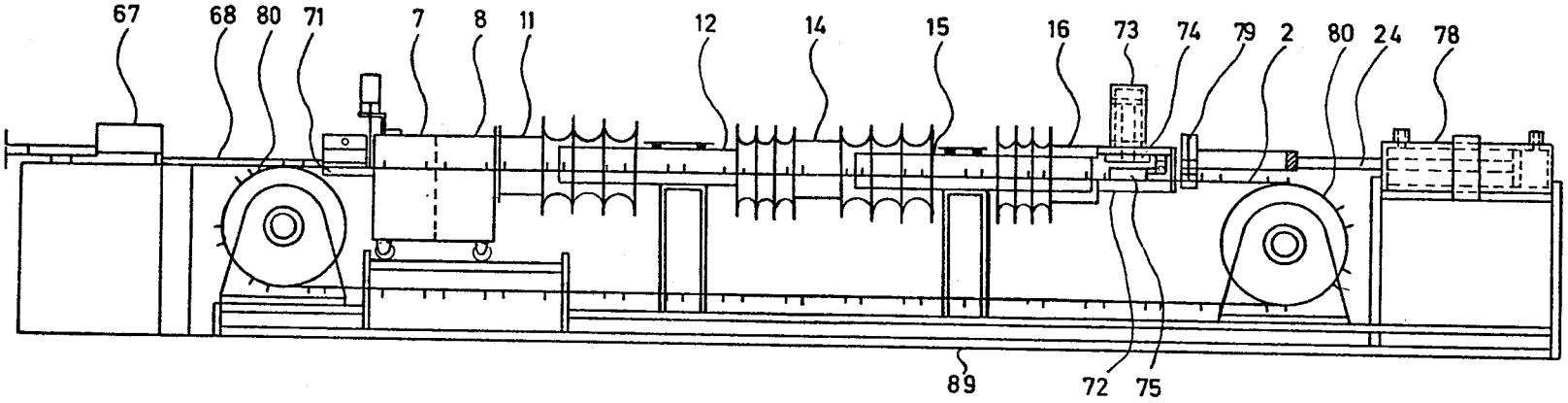
FIGS. 6*a* and 6*b* are a diagrammatic front elevational view of the machine for freeze-drying in bottles, and a top plan view of same, respectively.
Figure 6B:
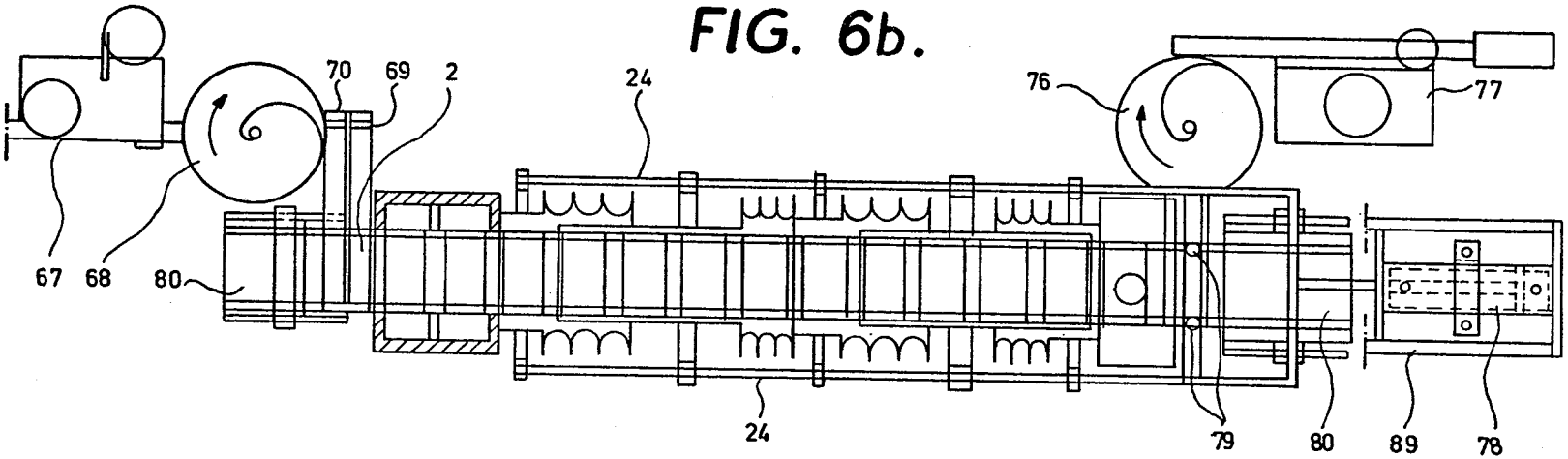

With the machine represented diagrammatically in FIG. 6, material packed in bottles for freeze-drying is continuously frozen, freeze-dried and sealed in a moisture-proof manner in accordance with the invention.

Figure 7A:
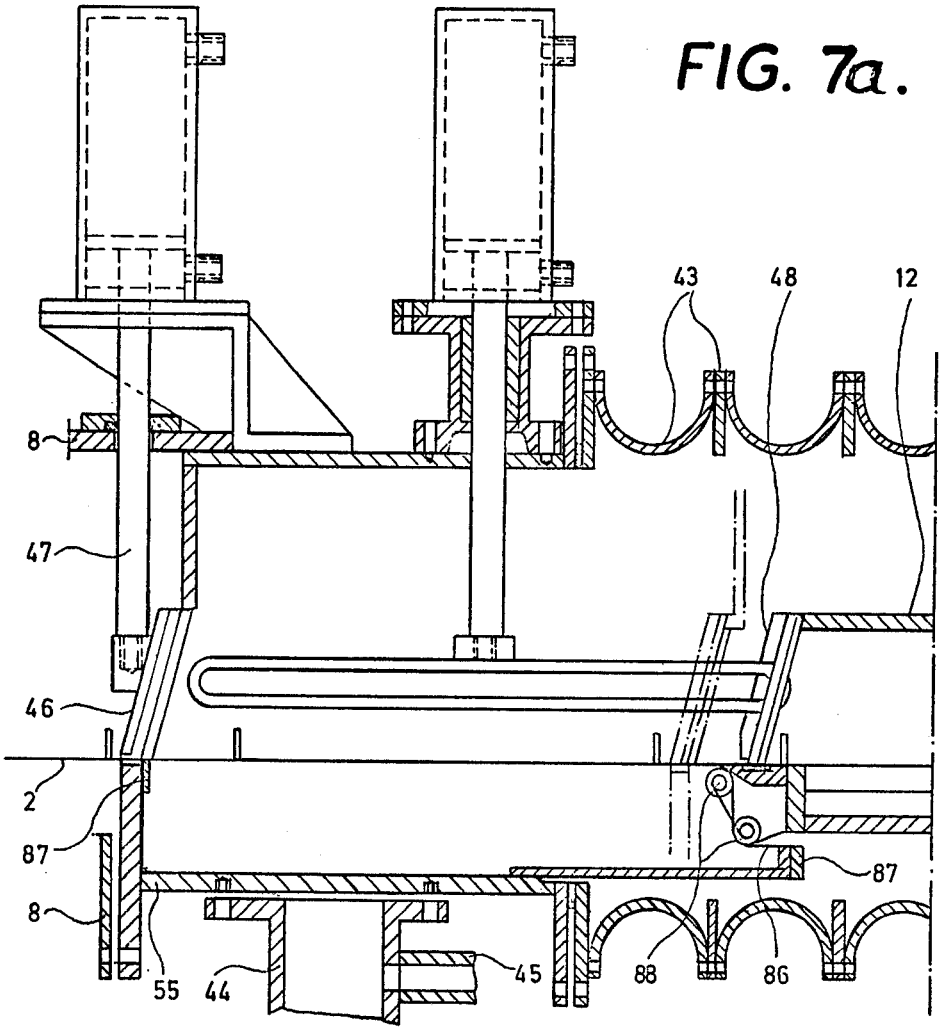
FIGS. 7*a* and 7*b* are a perpendicular longitudinal section taken through the air locks 11, 14 and 16 of the machine of FIG. 6, and a top plan view of same, respectively.
Figure 7B:
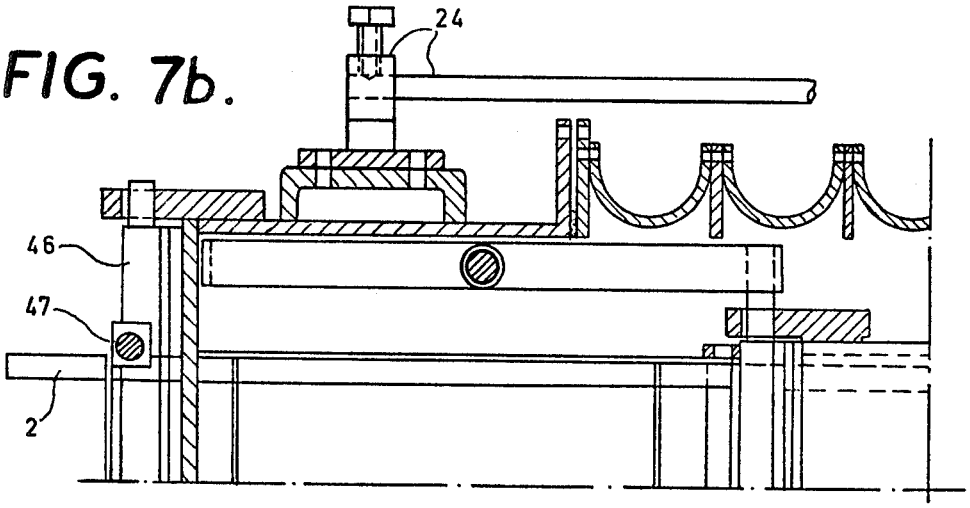
Figures 8A, 8B:
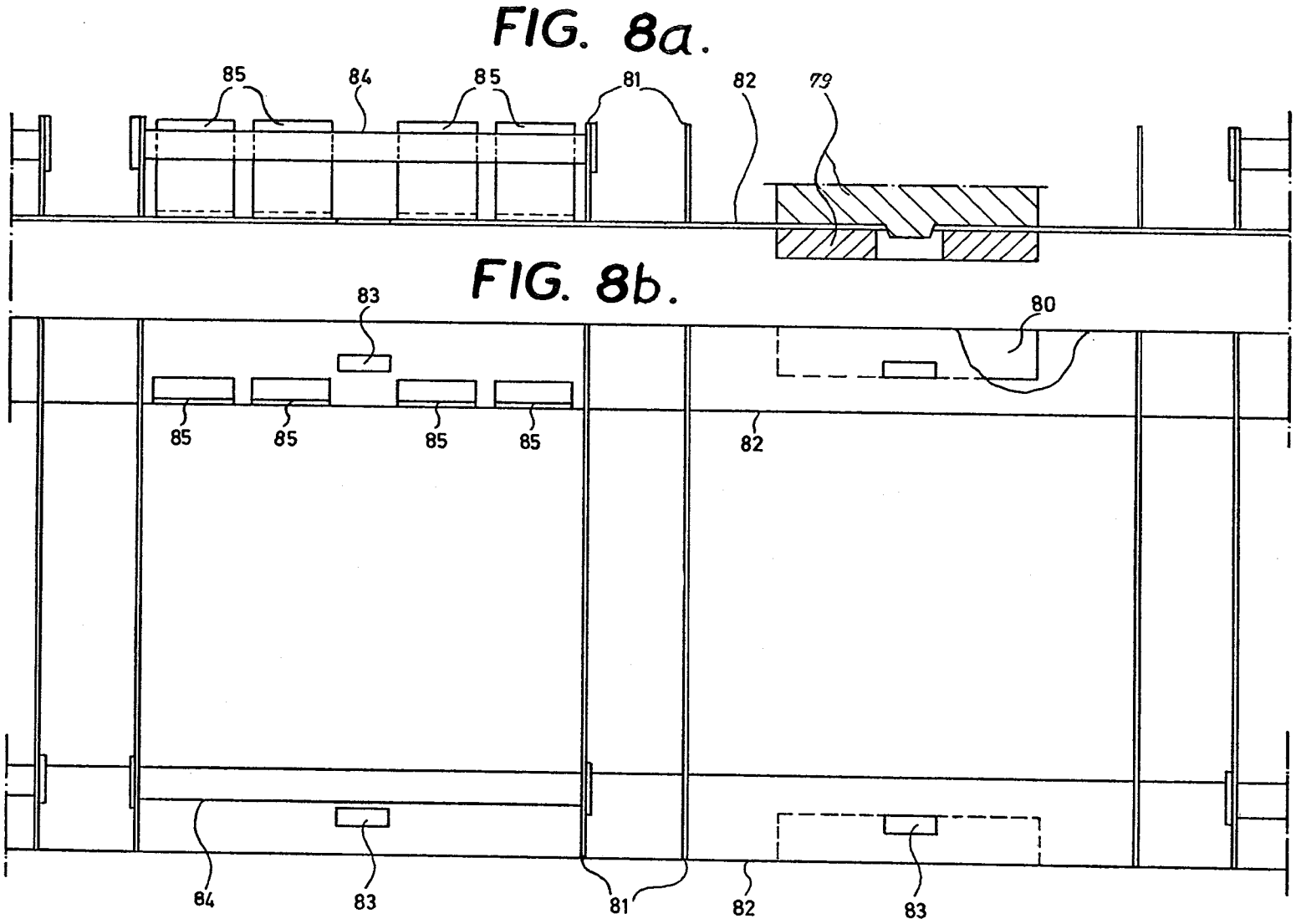
FIGS. 8*a* and 8*b* are front elevational and top plan view, respectively, of an embodiment of the conveyor belt 2 in the machine of FIG. 6.

The foil or film web in this case is replaced by a conveyor belt represented in FIG. 8. The design of the air locks provided with upwardly opening slide valves is represented in FIG. 7.

The bottles are filled by the filling and stoppering machine represented in FIG. 6, and provided with freeze-drying stoppers. Then the filled bottles are transported by the turntable 68 and the feeder 70 into the conveyor path 2 between two advancing strokes of the machine. The table 71 fastened to freezer 7 serves as a support for the bottles. In conveyor path 2, bottles are carried section by section through the freezers 7 and 8 and through the freeze-dry tunnels 12 and 15 and their air locks 11, 14 and 16.

At the exit of air lock 16 a stopper inserting means is fastened to the wall of the lock, which consists of a base plate 72 and a pressure plate 74 driven downwardly and upwardly by the hydraulic cylinder 73. In the stopper inserting means, which is hermetically sealed and flooded with nitrogen, the freeze-drying stoppers are forced into the bottles. Then the bottles are transported by the pushers 75 onto the turntable 76 and from there into the capping machine 77 where they are provided with screw caps.

The step-wise advancement is transmitted by the transport mechanism 78 through the push-pull linkage 24 to the hydraulically operated gripper 79 and to the locks 11, 14 and 16, and from there to the conveyor belt 2. The conveyor belt is carried and guided around the two drums 80.

The machine is assembled on the frame 89. The conveyor belt 2 represented in FIG. 8 consists of two metal belts 82 joined together by spacers 81 which are provided with openings for engagement by the transport cleats of the gripper 79. The spacers are welded to the metal belts.

One metal belt is provided with removable guides 84 which are installed each time a section of conveyor belt in the bottle feeding means has been loaded, and are removed after the conveyor belt has been unloaded in the stoppering station. The other metal belt has metal brackets 85 as guides which are affixed to the belt, for example by spot welding. During the freeze-drying process, the bottles stand between the metal belts 82 and the spacers 81, in direct contact with the tables 13 of the freeze-drying tunnels 12 and 15. In the machine of FIG. 6, the slide valves of the freezers 7 and 8 and the locks 11, 14 and 16 open upwardly.

The construction of the air locks 11, 14 and 16 is represented in FIG. 7. The steps of the operation of the air locks are identical to those previously described for the machine of FIG. 1. Air lock 16 is again in a mirror-image relationship to the air locks 11 and 14. The air locks are additionally provided with retractable trays 86 carrying the bottles, these trays being fastened by metal bars 87 to the rigid wall 55 of the air locks and, in the advancing movement of the locks, are drawn beneath the freeze-drying tunnels. In the advancing movement, the retractable tray 86 is carried on rollers 88 which are fastened and journaled to the freeze-drying tunnels.

The freezers 7 and 8 are fixedly joined to the air lock 11 and in the advancing movement they are also driven in the horizontal direction.

What is claimed is:

1. In an apparatus for the continuous preparation and packing of freeze-dried material, having a horizontally movable web and successively disposed forming, freezing, freeze-drying, heat-sealing, punching and transport devices, wherein the improvement comprises the freeze-drying devices consist of two successively disposed freezers having separate refrigerant circuits, and a primary drying tunnel and a secondary drying tunnel having separate evacuating and heating systems, hermetically closable air locks located ahead of the primary drying tunnel, between the primary and secondary drying tunnels, and at the end of the secondary drying tunnel, said air locks comprising compressible and expandable walls, retractable tables and upwardly and downwardly opening slide valves for sealing the primary drying tunnel hermetically from the secondary drying tunnel and advancing means coupled to the air locks and movable in the horizontal direction to effect the expansion and compression of the air lock walls for advancing the movable web.

2. The apparatus of claim 1, characterized in that the expanding and contracting walls of the air locks, are disposed about the primary drying tunnel and the secondary drying tunnel, and comprise stable metal parts capable of withstanding the vacuum forces, and one of flexible metal, rubber or plastic parts, which are joined together hermetically.

3. The apparatus of claim 1, characterized in that the air locks have guiding parts inside and outside of the locks and parts fastened to the outside of the freeze-drying tunnel carrying the guiding parts.

4. The apparatus of claim 1, characterized in that the air locks comprise rigid lock walls fastened to the retractable tables for advancing containers on the web, the tables being moved by the advancing movement of the locks and being guided by rollers which are fastened to the stationary freeze-drying tunnels.

5. The apparatus of claim 1, characterized in that the freeze drying tunnels have tables and the web comprises a conveyor belt consisting of two metal belts provided with openings joined together by fixedly mounted and removable guiding parts and spacing means which advance containers standing on and in direct contact with the tables.

6. The apparatus of claim 1, characterized in that the freezers comprise horizontally movable slide valves which open and close in step with the machine and are fixedly joined to the air lock and retractable, bottle-bearing trays disposed for movement in the horizontal direction.

7. The apparatus according to claim 1, wherein the web comprises one of foil and film formed into a plurality of rows of cups in the forming device.

* * * * *